US009446623B2

(12) United States Patent
Black et al.

(10) Patent No.: US 9,446,623 B2
(45) Date of Patent: Sep. 20, 2016

(54) EGG DECORATING KIT

(75) Inventors: Allison R. Black, Minneapolis, MN (US); Jessica M. Krawczak, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 269 days.

(21) Appl. No.: 13/473,781

(22) Filed: May 17, 2012

(65) Prior Publication Data

US 2012/0308692 A1 Dec. 6, 2012

Related U.S. Application Data

(60) Provisional application No. 61/491,699, filed on May 31, 2011.

(51) Int. Cl.
*B44C 5/00* (2006.01)
*B44D 3/00* (2006.01)

(52) U.S. Cl.
CPC .. *B44C 5/00* (2013.01); *B44D 3/00* (2013.01)

(58) Field of Classification Search
CPC ..... B44C 5/00; B44D 3/00; B44D 3/22; G09F 1/00; G09F 1/04; B65D 5/425
USPC ..... 426/104, 383, 86, 106, 112, 302, 394
See application file for complete search history.

(56) References Cited

U.S. PATENT DOCUMENTS 521,141 A * 6/1894 Fitch ..... 206/521.6
1,296,158 A * 3/1919 Bonham ..... 206/752
1,486,145 A * 3/1924 Johnson ..... 206/486
1,544,311 A * 6/1925 Graffenberger ..... 206/521.1
1,631,205 A 6/1927 Homer et al.
1,793,861 A * 2/1931 Mallgraf ..... 40/539
2,019,953 A * 11/1935 Curtis ..... 206/763
2,036,822 A * 4/1936 Myers ..... 206/45.27
2,109,965 A 3/1938 Booth
2,134,908 A * 11/1938 Copeman ..... 206/521.7

(Continued)

FOREIGN PATENT DOCUMENTS

DE 3513351 A1 * 10/1986 ..... B65D 5/32

OTHER PUBLICATIONS

"Egg drying techniques" Apr. 1, 2010 http://www.sandytoesandpopsicles.com/life/egg-dying-techniques-part-2/.*

(Continued)

*Primary Examiner* — Viren Thakur
(74) *Attorney, Agent, or Firm* — Merek, Blackmon & Voorhees, LLC

(57) ABSTRACT

An egg decorating kit formable into an egg decorating assembly includes a plurality of decorating accessories for decorating eggs, a box made of foldable sheet material and an attachment made of sheet material. The box includes a top having a plurality of demarcated sections peripherally arranged about a center point of the top of the box. The top has at least one slit that extends from an outer surface of the top to an inner surface of the top and is surrounded by the demarcated sections. The attachment includes a main body portion and a tab portion coupled to the main body portion. The main body portion has printed indicia located on a front side of the sheet material and printed indicia located on a back side of the sheet material.

9 Claims, 9 Drawing Sheets

(56) References Cited

U.S. PATENT DOCUMENTS

| | | | | | |
|---|---|---|---|---|---|
| 2,152,649 | A | * | 4/1939 | Bartlett | 206/521.15 |
| 2,258,716 | A | * | 10/1941 | Reginald et al. | 229/120.14 |
| 2,424,538 | A | | 7/1947 | Beder | |
| 2,648,151 | A | * | 8/1953 | Kindred | 40/539 |
| 2,776,082 | A | * | 1/1957 | Bennorth | 206/521.7 |
| 2,833,458 | A | * | 5/1958 | Toensmeier | 206/562 |
| 2,975,547 | A | * | 3/1961 | Greve | 446/77 |
| 3,209,980 | A | * | 10/1965 | Festa | 206/521.1 |
| 3,228,518 | A | * | 1/1966 | Coby | 206/562 |
| 3,390,783 | A | * | 7/1968 | Quackenbush, Jr. | 211/73 |
| 3,429,427 | A | * | 2/1969 | Wolf | 206/214 |
| 3,440,747 | A | * | 4/1969 | Oliver | 40/539 |
| D216,901 | S | | 3/1970 | Klamer | |
| D216,997 | S | | 3/1970 | Klamer | |
| 3,594,936 | A | * | 7/1971 | Blum | 40/124.19 |
| 3,745,973 | A | * | 7/1973 | Knecht | 118/400 |
| 3,829,348 | A | | 8/1974 | Spiegel et al. | |
| 3,837,111 | A | | 9/1974 | Godfrey et al. | |
| D264,198 | S | | 5/1982 | Leeds | |
| 4,531,475 | A | * | 7/1985 | Thill | 118/503 |
| 4,573,586 | A | | 3/1986 | Helmer | |
| 4,599,235 | A | * | 7/1986 | Miller | A23G 3/28 156/297 |
| D285,545 | S | | 9/1986 | Crouch | |
| 4,693,205 | A | * | 9/1987 | Thill | 118/13 |
| D354,421 | S | | 1/1995 | Helmer | |
| 5,685,438 | A | * | 11/1997 | Emanuel et al. | 211/70.1 |
| 5,693,352 | A | * | 12/1997 | Vogel Goodman | 426/250 |
| 5,725,109 | A | * | 3/1998 | Moulton et al. | 211/73 |
| 5,779,059 | A | | 7/1998 | Kotch | |
| D402,501 | S | | 12/1998 | Powers | |
| 5,895,679 | A | | 4/1999 | Pender et al. | |
| 6,105,796 | A | * | 8/2000 | Buchanan et al. | 211/128.1 |
| 6,110,514 | A | | 8/2000 | Powers | |
| 6,168,021 | B1 | * | 1/2001 | Herbruck | 206/541 |
| D442,650 | S | | 5/2001 | Allen | |
| 6,238,260 | B1 | * | 5/2001 | Spindell | 446/72 |
| 6,643,962 | B1 | * | 11/2003 | Panec et al. | 40/539 |
| 6,769,206 | B2 | * | 8/2004 | Olson | 40/538 |
| 7,546,703 | B2 | * | 6/2009 | Johnske et al. | 40/539 |
| 2002/0036053 | A1 | | 3/2002 | Weder et al. | |
| 2002/0097238 | A1 | | 7/2002 | Tura | |
| 2010/0077704 | A1 | * | 4/2010 | Weder | 53/473 |
| 2010/0293823 | A1 | * | 11/2010 | Hsu | 40/124.191 |

OTHER PUBLICATIONS

"Eco-egg Dyeing" Apr. 10, 2009 http://www.freerepublic.com/focus/chat/2226705/posts.*

"eHow—How to Decorate Eggs with Crayons." Mar. 16, 2008 http://web.archive.org/web/20080316161916/http://www.ehow.com/how_15778_decorate-eggs-with.htm.*

"Spring Egg Decorating." Mar. 20, 2010 http://mommypoppins.com/newyorkcitykids/spring-egg-decorating.*

Baker, Barbara. "Fun Easter Activities to Do as a Family; PAAS Easter Egg Dye Kits Review." Apr. 10, 2009 http://www.lifelovebeauty.com/405-fun-easter-activities-to-do-as-a-family-paas-easter-egg-dye-kits-review/.*

Tirips, Miriam. "Colorful, Decorating, Eggy Fun!—Paas Easter Egg Decorating Kits Review & Egg Coloring Instructions." Mar. 22, 2010 http://www.wicproject.com/giveaway/paas/.*

Linette, "New PAAS Easter Egg Decorating Kits," Mar. 27, 2010, The Kid's Fun Review, 3 pages, http:// kidsfunreviewed.com/new-paas-easter-egg-decorating-kits/.

Williams-Sonoma, "Easter Egg Decorating Kit," 1 page, http://www.williams-sonoma.com/products/easter-egg-decorating-kit/, at least as early as May 17, 2011.

* cited by examiner

EGG DECORATING KIT

CROSS-REFERENCE TO RELATED APPLICATION

The present application is based on and claims the benefit of U.S. provisional patent application Ser. No. 61/491,699, filed May 31, 2011, the content of which is hereby incorporated by reference in its entirety.

BACKGROUND

Decorating eggs is an art or craft where the shell of an egg is carved, dyed, painted, appliquéd or otherwise decorated using a variety of different techniques. Commercial egg decorating kits are packaged for purchase and include materials, accessories and instructions for decorating eggs.

The discussion above is merely provided for general background information and is not intended to be used as an aid in determining the scope of the claimed subject matter.

SUMMARY

An egg decorating kit includes a plurality of decorating accessories for decorating eggs. The kit also includes a carton made of sheet material having a top panel with interior and exterior surfaces. The carton includes a plurality of perforated sections defining removable pieces of sheet material for forming openings in the top panel. Each of the perforated sections are spaced apart from each other and peripherally arranged about a midpoint of the top panel. The carton also includes at least one through cut formed in the top panel and extending from the exterior surface to the interior surface of the top panel. The at least one through cut located within an area defined by the peripherally arranged plurality of perforated sections. The kit also includes an attachment made of sheet material and having a main body portion and a tab portion coupled to the main body portion. The main body portion includes printed indicia located on a front side of the sheet material and printed indicia located on a back side of the sheet material.

Components of the kit are used to assemble an egg display. Assembling the egg display includes removing at least one the removable sections of material defined by one of the plurality of perforated sections in the top panel to form at least one opening. A decorated egg is placed in the at least one opening and the tab portion of the attachment is inserted through the at least one through cut such that the attachment protrudes from the exterior surface of the top panel and at least a part of the main body portion of the attachment extends above the decorated egg.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF DRAWINGS

DETAILED DESCRIPTION

Embodiments described herein are directed to an egg decorating kit including a carton made of sheet material and an assortment of egg decorating accessories. The carton contains or houses the egg decorating accessories and can also be used to form an egg decorating assembly, which displays decorated eggs. The egg decorating accessories include various craft items or supplies including dye, stickers, decals, egg holders made of sheet material and an attachment made of sheet material for attaching to the carton. The carton includes a top panel having a plurality of perforated sections spaced apart from each other and peripherally arranged about a midpoint of the top panel. The plurality of perforated sections define removable sections of the sheet material for forming openings to receive and support eggs. The top panel of the carton also includes at least one through cut for receiving the attachment made of sheet material.

Figure 1:
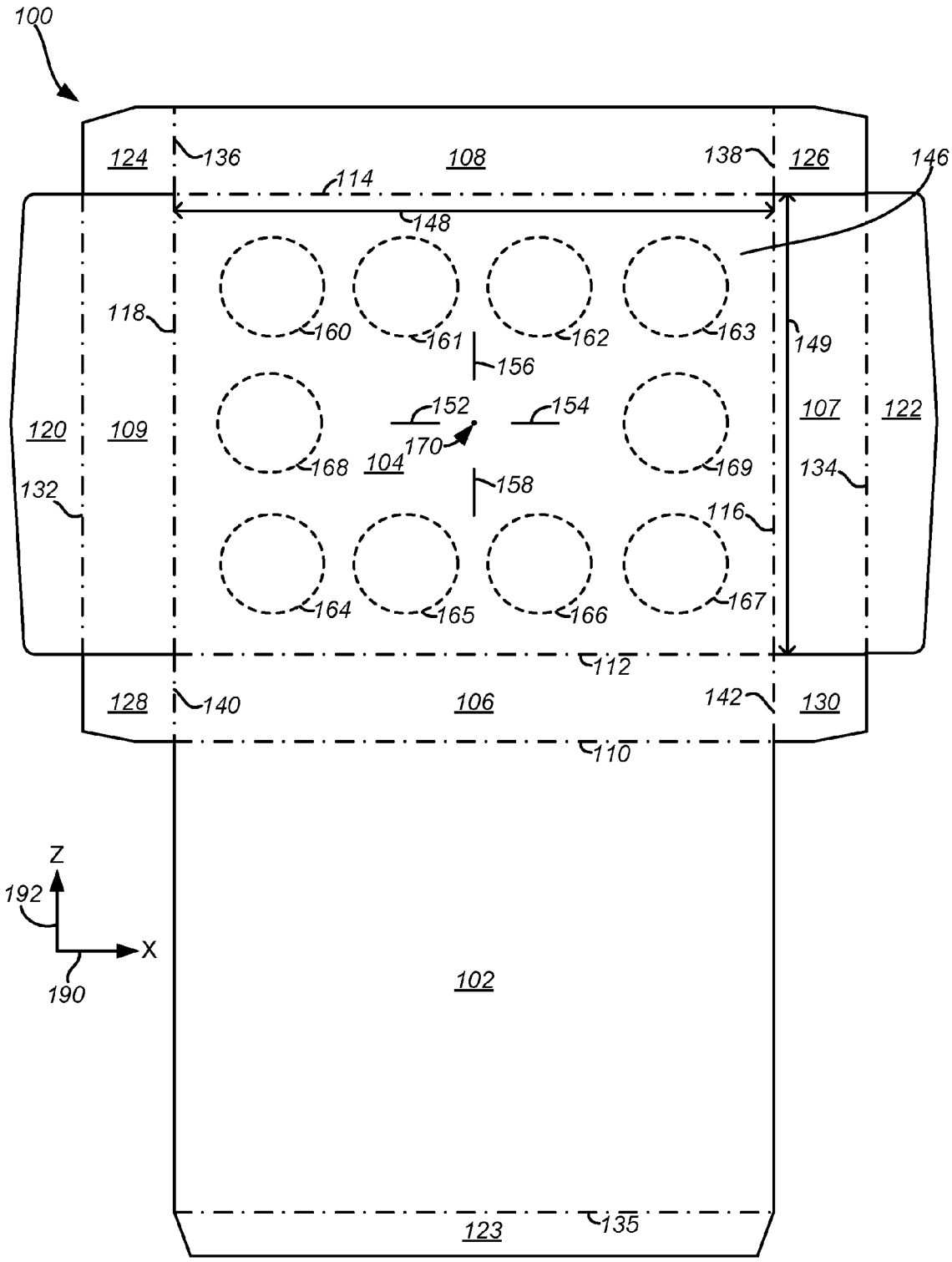
FIG. 1 illustrates a plan view of a sheet material formable into a carton for housing an egg decorating kit according to one embodiment.

FIG. 1 illustrates a plan view of a sheet material 100 formable into a carton or a box for housing an egg decorating assembly according to one embodiment. Sheet material 100 includes a bottom panel 102, a top or top panel 104, a front or a front panel 106, a back or a back panel 108 and two sides or side panels 107 and 109. Bottom panel 102 is coupled to top panel 104 via front panel 106. In particular, bottom panel 102 is coupled to front panel 106 by a first score 110. Front panel 106 is coupled to top panel 104 by a second score 112. Back panel 108 is located opposite front panel 106 when sheet material 100 is folded into a carton and is coupled to top panel 104 by a third score 114. First side panel 107 is coupled to top panel 104 by a fourth score 116. Second side panel 109 is located opposite first side panel 107 when sheet material 100 is folded into a carton and is coupled to top panel 104 by a fifth score 118.

Sheet material 100 also includes three tuck flaps 120, 122 and 123 and four ear flaps 124, 126, 128 and 130. First tuck flap 120 is coupled to second side panel 109 by a sixth score 132, second tuck flap 122 is coupled to first side panel 107 by a seventh score 134 and third tuck flap 123 is coupled to top panel 102 at an eighth score 135. When forming sheet material 100 into a carton, first tuck flap 120 is configured to attach to bottom panel 102, second tuck flap 122 is configured to attach to bottom panel 102 and third tuck flap 123 is configured to attach to back panel 108. Under one embodiment, each attachment of a tuck flap is made using an adhesive.

First ear flap 124 is coupled to back panel 108 by an ninth score 136. Second ear flap 126 is coupled to back panel 108 opposite the first ear flap 124 by a tenth score 138. Third ear flap 128 is coupled to front panel 106 by an eleventh score 140 and fourth ear flap 130 is coupled to front panel 106 opposite the third ear flap 128 by a twelfth score 142. When forming sheet material 100 into a carton, first ear flap 124 is configured to attach to second side panel 109, second ear flap 126 is configured to attach to first side panel 107, third ear flap 128 is configured to attach to second side panel 109 and fourth ear flap 130 is configured to attach to first side panel 107. Under one embodiment, each attachment of an ear flap is made using an adhesive.

Top panel 104 includes a plurality of perforated sections or demarcated shapes 160, 161, 162, 163, 164, 165, 166, 167, 168 and 169 that define removable sections of sheet material. While FIG. 1 illustrated the perforated sections as being perforated circles, it should be realized other perforated geometric shapes are possible including rectilinear and other circular-type shapes. Each perforation in each perforated section extends from an exterior or outer surface 146 of top panel 104 through the material to an opposing interior or inner surface of top panel 104. As illustrated in FIG. 1, sheet material 100 includes ten spaced apart perforated sections arranged such that there are four sections or circles 160, 161, 162 and 163 extending across a width 148 of top panel 104 adjacent to third score 114 and four sections or circles 164, 165, 166 and 167 extending across the width 148 of top panel 104 adjacent to second score 112, where each of the first, second, third and fourth perforated sections 160, 161, 162 and 163 positioned along third score 114 are in alignment with each of the fifth, sixth, seventh and eighth perforated sections 164, 165, 166 and 167 positioned along second score 112. Located between first perforated section 160 and fifth perforated section 164 along fifth score 118 is the ninth perforated section 168 and located between the fourth perforated section 163 and the eighth perforated section 167 along fourth score 116 is the tenth perforated section 169. In other words, the plurality of perforated sections 160-169 are peripherally arranged about a center point 170 of top panel 104. In FIG. 1, the peripheral arrangement forms a rectangle. When sheet material located inside at least one of the plurality of perforated sections is removed, the perforated sections form jagged openings in top panel 104. Each of the jagged openings is configured to support an egg in an upright position.

Figure 2:
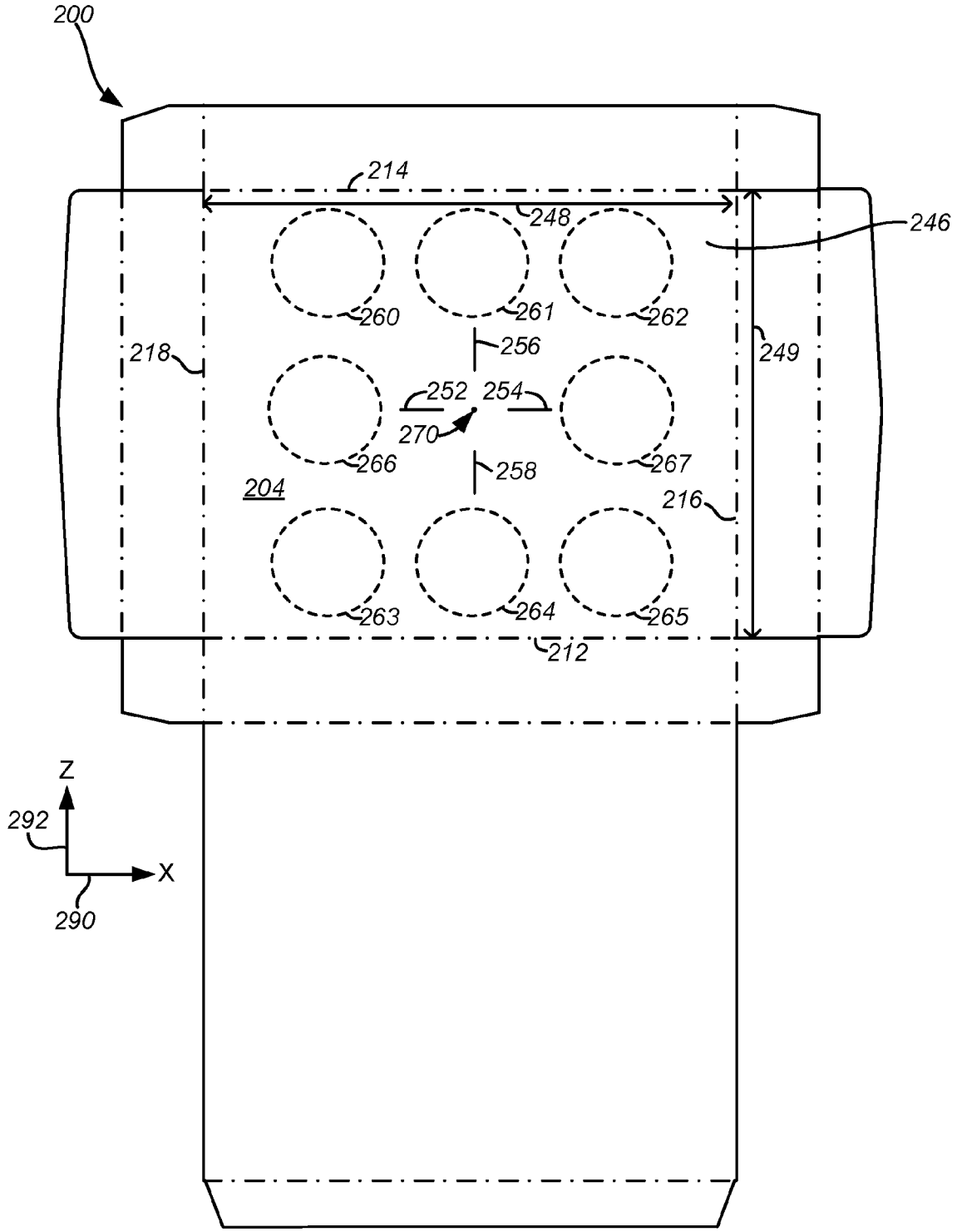
FIG. 2 illustrates a plan view of a sheet material formable into a carton for holding an egg decorating kit according to another embodiment.

While top panel 104 of sheet material 100 includes ten perforated sections, any number of perforated sections are possible. For example, FIG. 2 illustrates another embodiment of sheet material 200 formable into a carton or box. Sheet material 200 includes eight perforated sections. Each perforation of perforated sections 260, 261, 262, 263, 264, 265, 266 and 267 extends from an exterior or outer surface 246 of top panel 204 through the material to an interior or inner surface of top panel 204. The eight perforated sections are arranged such that there are three perforated sections 260, 261 and 262 extending a width 248 of top panel 204 adjacent third score 214 and three perforated sections 263, 264 and 265 extending along a width 248 of top panel 204 adjacent second score 212, where each of the first, second and third perforated sections 260, 261 and 262 positioned along third score 214 are in alignment with each of the fourth, fifth and sixth perforated sections 263, 264 and 265 positioned along second score 212. Located between the first perforated section 260 and the fourth perforated section 263 along a fifth score 218 is the seventh perforated section 266 and located between the third perforated section 262 and the sixth perforated section 265 along a fourth score 216 is the eighth perforated section 267. In other words, the plurality of perforated sections 260-267 are peripherally arranged about a center point 270 of top panel 204. In FIG. 2, the peripheral arrangement forms a square.

With reference to both FIGS. 1 and 2, each of sheet material 100 and sheet material 200 include at least one through cut or slit formed in top panel 104 and 204, respectively, that extends from exterior surface 146, 246 of top panel 104, 204 through the sheet material to the interior surface of top panel 104, 204. The at least one through cut is spaced apart from the plurality of perforated sections that have removable pieces of material and is located within an area defined by the peripheral arrangement of perforated sections. In the exemplary embodiments illustrated in FIGS. 1 and 2, sheet material 100 and sheet material 200 include a plurality of through cuts arranged about respective center points 170 and 270 on top panel 104 and 204. Center points 170 and 270 of top panels 104 and 204 are defined by the intersection of respective midpoints of the widths 148 and 248 of top panels 104 and 204 and respective midpoints of the depths 149 and 249 of top panels 104 and 204.

As illustrated in FIGS. 1 and 2, sheet material 100 includes four through cuts 152, 154, 156 and 158. Through cuts 152, 154, 156 and 158 do not intersect with center point 170, but are provided in a radial arrangement about center point 170. Sheet material 200 also includes four through cuts 252, 254, 256 and 258. Through cuts 252, 254, 256 and 258 do not intersect with center point 170, but are provided in a radial arrangement about center point 270. In particular, a first through cut 152, 252 and a second through cut 154, 254 are spaced apart from each other and oriented substantially along an X axis 190, 290. A third through cut 156, 256 and a fourth through cut 158, 258 are spaced apart from each other and oriented substantially along a Z axis 192, 292. When sheet material 100 and 200 are formed into cartons, an attachment is configured to be inserted into at least one of the plurality of through cuts for projecting upwardly along a Y axis 800 from top surface 146, 246 of top panel 104, 204.

Figure 3:
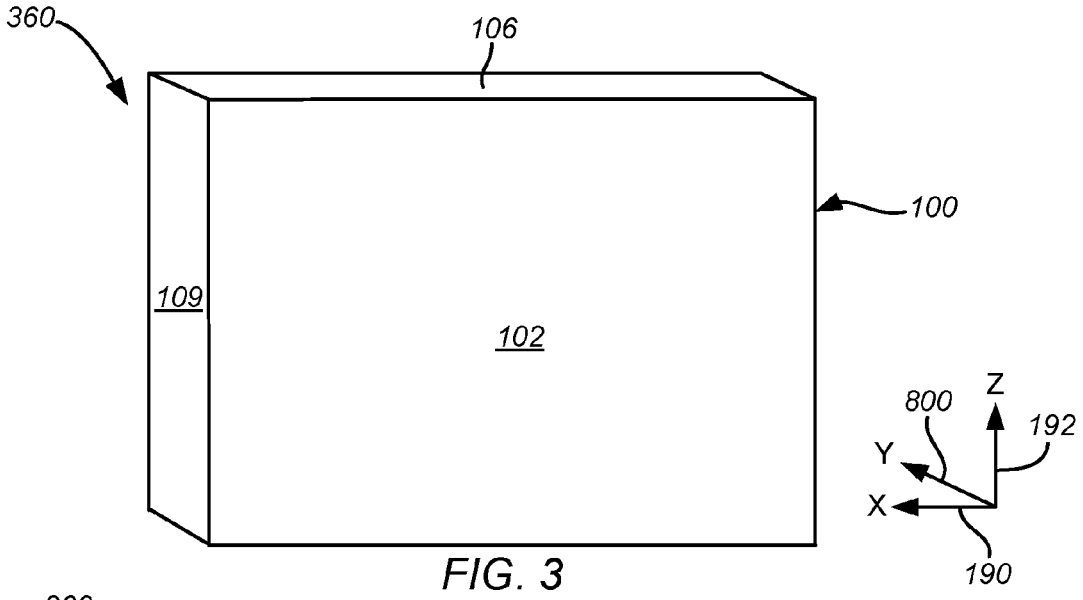
FIG. 3 is a bottom perspective view of a carton made from the sheet material illustrated in FIG. 1.
Figure 4:
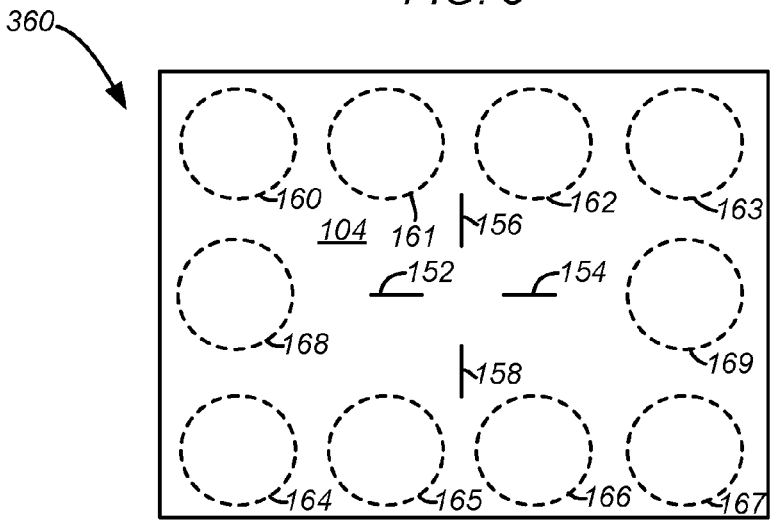
FIG. 4 is a top plan view of the carton illustrated in FIGS. 1 and 3.
Figure 5:
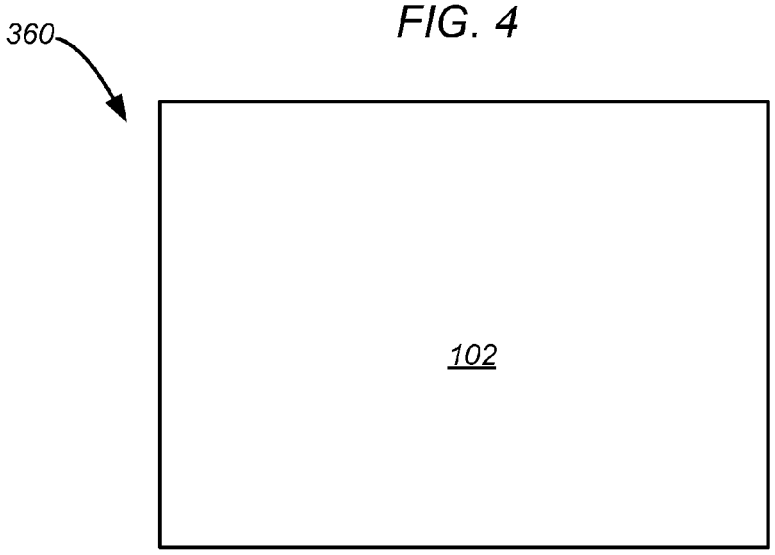
FIG. 5 is a bottom plan view of the carton illustrated in FIGS. 1 and 3.
Figure 6:
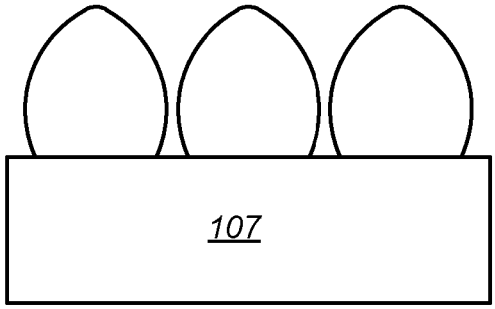
FIG. 6 is a side view of the carton illustrated in FIGS. 1 and 3, but with removable sections of material removed to form openings for receiving eggs, the opposite side being a mirror image.
Figure 7:
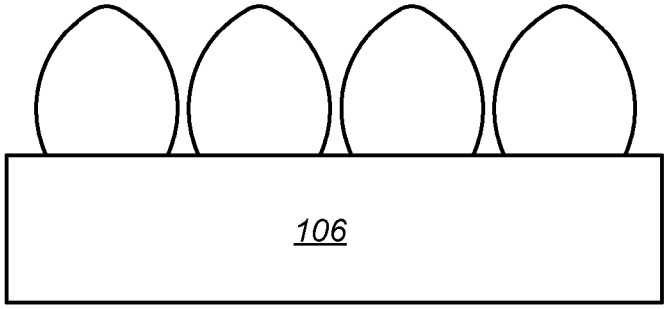
FIG. 7 is a front view of the carton and eggs illustrated in FIG. 6, the back being a mirror image.
Figure 8:
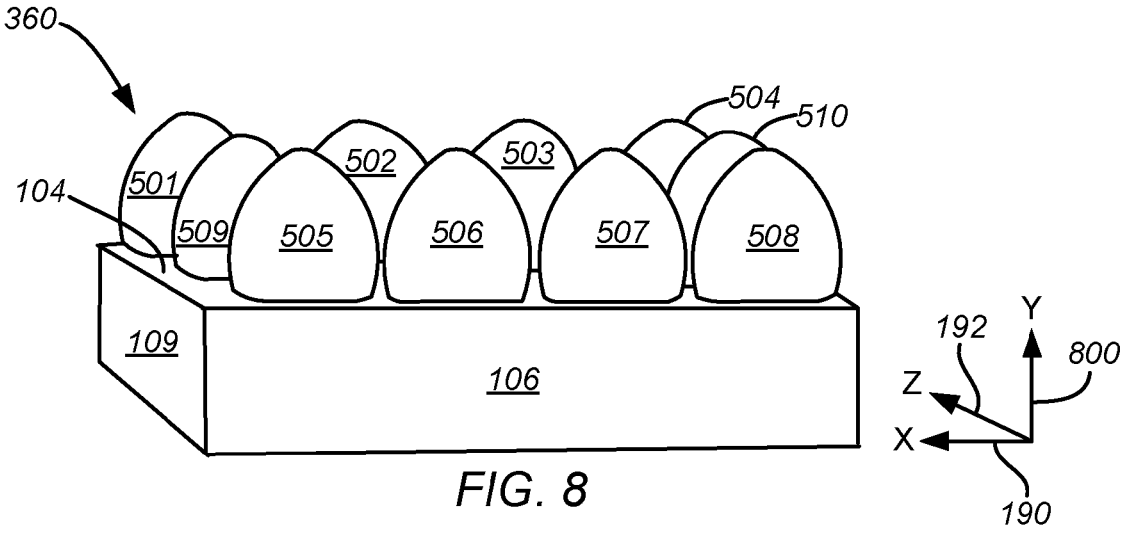
FIG. 8 is a top perspective view of the carton and eggs illustrated in FIG. 6.

FIG. 3 illustrates a bottom perspective view of sheet material 100 illustrated in FIG. 1 formed into a carton or box 360, while FIGS. 4-7 illustrate elevation views of sheet material 100 formed into carton or box 360 including a top view, a bottom view, a front view (which is identical to an opposing back view) and a right side view (which is identical to an opposing left side). In addition, FIG. 8 is a top perspective view of sheet material 100 formed into carton or box 360 and illustrating material removed or "punched out" from the plurality of perforated sections to form respective openings for supporting a plurality of eggs 501-510 upright in each of the openings defined by the perforated sections 160-169. More specifically, sheet material 100 is folded at its scores and tuck flaps and ear flaps are adhesively assembled to respective panels. As shown, bottom panel 102, top panel 104, front panel 106, right side panel 107 and left side panel 109 are visible. In addition, the openings support decorated eggs 501-510 for drying.

Figure 9:
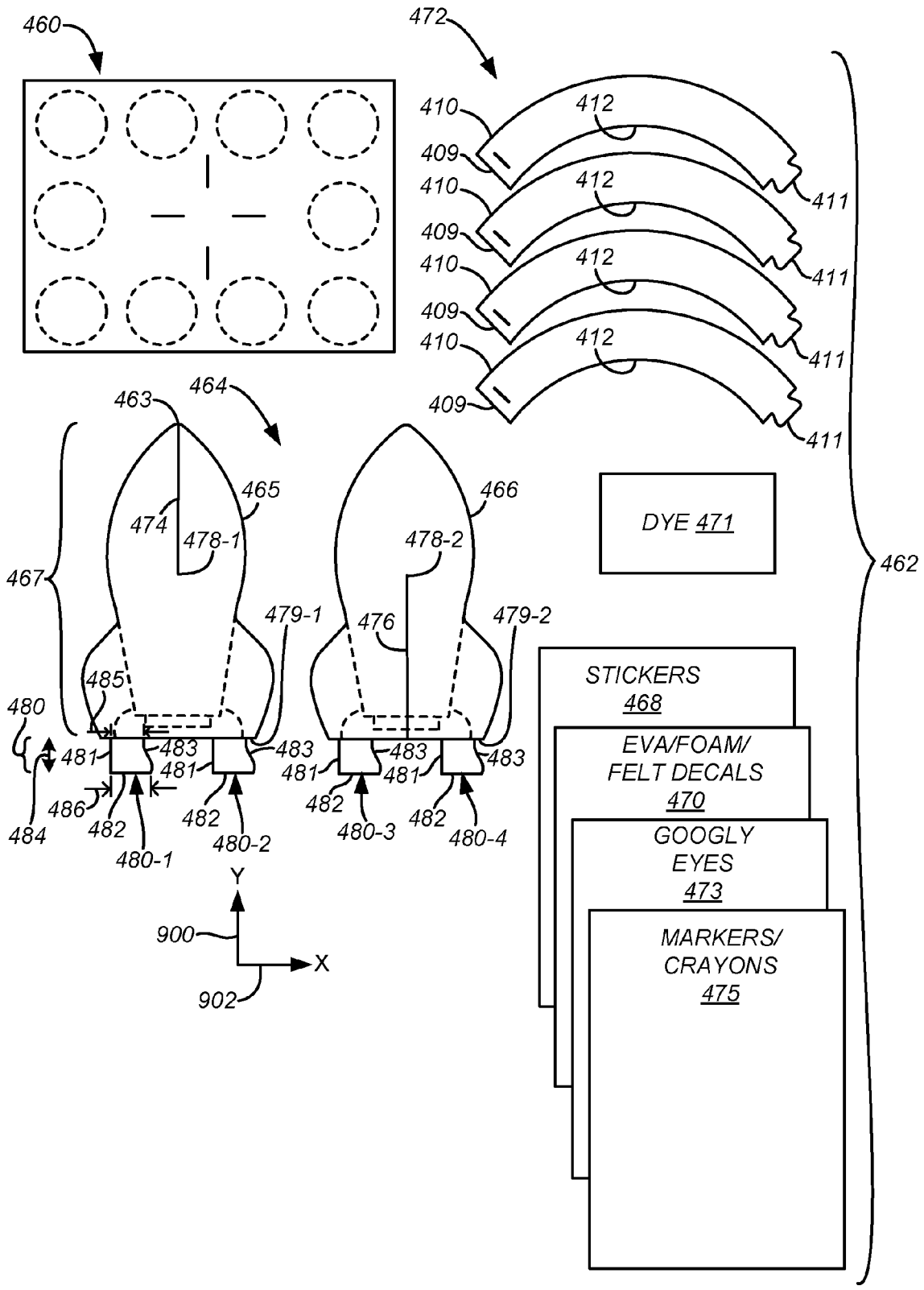
FIG. 9 illustrates an egg decorating kit according to one embodiment.

FIG. 9 illustrates a plurality of items or supplies 462 included in an egg decorating kit according to one embodiment. Items 462 include a carton or box 460, such as the carton or box 360 illustrated in FIGS. 4-8 and formable from sheet material 100 of FIG. 1, an attachment 464 made of sheet material, a plurality of egg stands 472 made of sheet material and plurality of decorating accessories for decorating eggs.

The attachment 464 is for attaching to carton 460. The egg stands include top arc edges 410 that have lengths that are substantially the same as the length of their bottom arc edges 412. The two side edges 409 and 411 of each egg stand 472 attach together to form a circular support for supporting an egg. For example, the side edges 409 and 411 can include a tab and slot as illustrated in FIG. 9 for connecting together or adhesive. The plurality of decorating accessories include a plurality of decals, such as stickers 468 mounted to a liner sheet, ethylene-vinyl acetate (EVA) pieces, felt or foam pieces 470, a plurality of googly eyes 473, at least one marker and/or crayon 475 and dye 471. Googly eyes 473 are a craft supply that imitates eye balls. Googly eyes 472 include a plurality of hard, clear plastic shells holding a black plastic disk that is allowed to move freely.

Attachment 464 includes at least a first piece or first attachment 465 and a second piece or second attachment 466. Both first piece 465 and second piece 466 have main body portions 467 that represent an iconic shape and include indicia related to the shape, which is printed on both a front side of main body portion 467 and on a back side of main body portion 467. As illustrated in FIG. 9, main body portions 467 represent a rocket. However, other shapes and printed indicia can be used.

The main body portion 467 of first piece 465 includes a first slot 474 and main body portion 467 of second piece 466 includes a second slot 476. First slot 474 of first piece 465 extends from a top 463 of first piece 465 or, in other words, from an edge of the nose of the rocket and terminates at a terminating point 478-1. Second slot 476 of second piece 466 extends from a bottom edge 479-2 of the main body portion 467 or, in other words, from a base of the rocket and terminates at a terminating point 478-2 of the second piece 466.

First and second pieces 465 and 466 of attachment 464 also include tab portions 480 having downwardly depending tabs. As illustrated, the tab portion of first piece 465 includes a first tab 480-1 and a second tab 480-2 coupled to or depending downwardly from a bottom edge 479-1 of the main body portion 467 and terminating at free edges. The tab portion of second piece 466 includes a third tab 480-3 and a fourth tab 480-4 coupled to or depending downwardly from bottom edge 479-2 of main body portion 467 and terminating at free edges. Tabs 480-1, 480-2, 480-3 and 480-4 include three free edges. A first free edge 481 is a vertical edge oriented substantially along a Y axis 900, second free edge 482 is a horizontal edge oriented substantially along an X axis 902 and third free edge 483 is a curved edge, which opposes vertical edge 481. While each tab 480-1, 480-2, 480-3 and 480-4 includes a single height dimension 484, each tab 480-1, 480-2, 480-3 and 480-4 includes two widths. A first width 485 extends along the bottom edges 479-1 and 479-2 or base of the rockets and is less than a second width 486 that extends along second free or horizontal edge 482. First width 485 substantially corresponds with the length of each of the through cuts in the top panel of carton 460.

Figure 10:
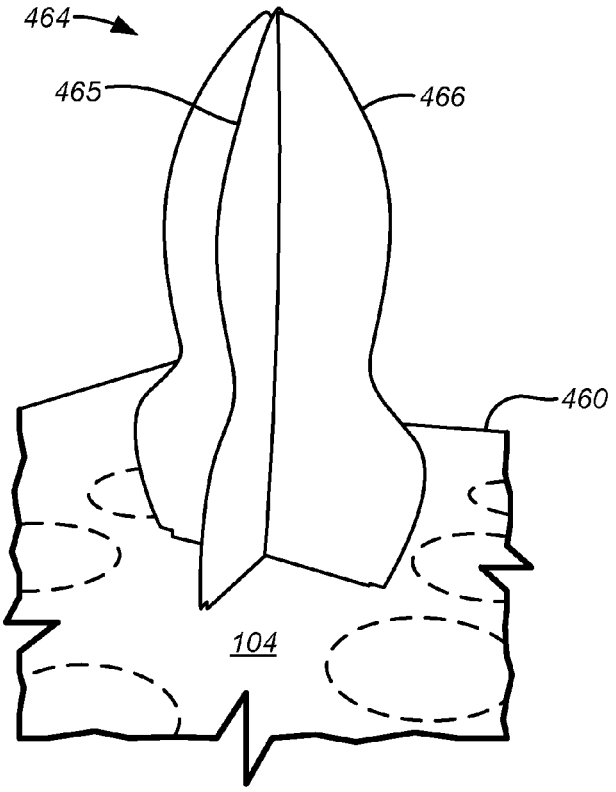
FIG. 10 illustrates a perspective view of an attachment attached to the carton that houses the egg decorating kit according to one embodiment.
Figure 11:
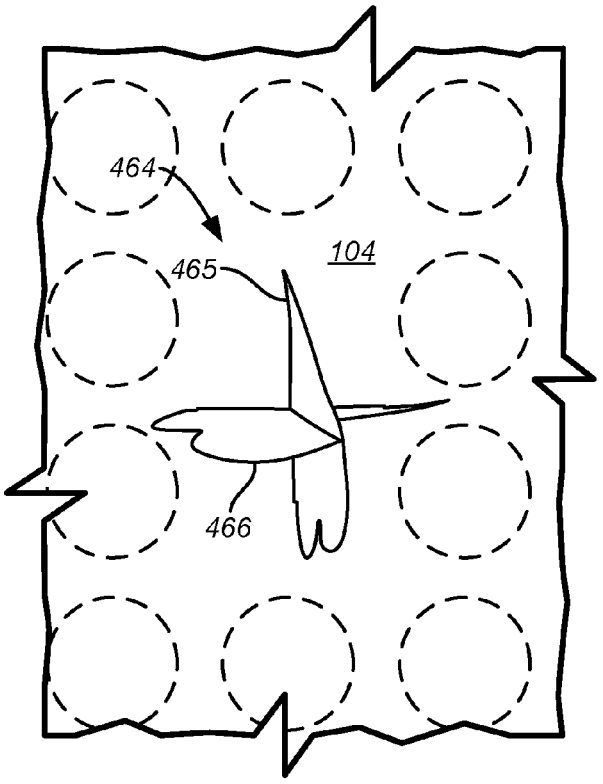
FIG. 11 illustrates a top view of the attachment illustrated in FIG. 10.
Figure 12:
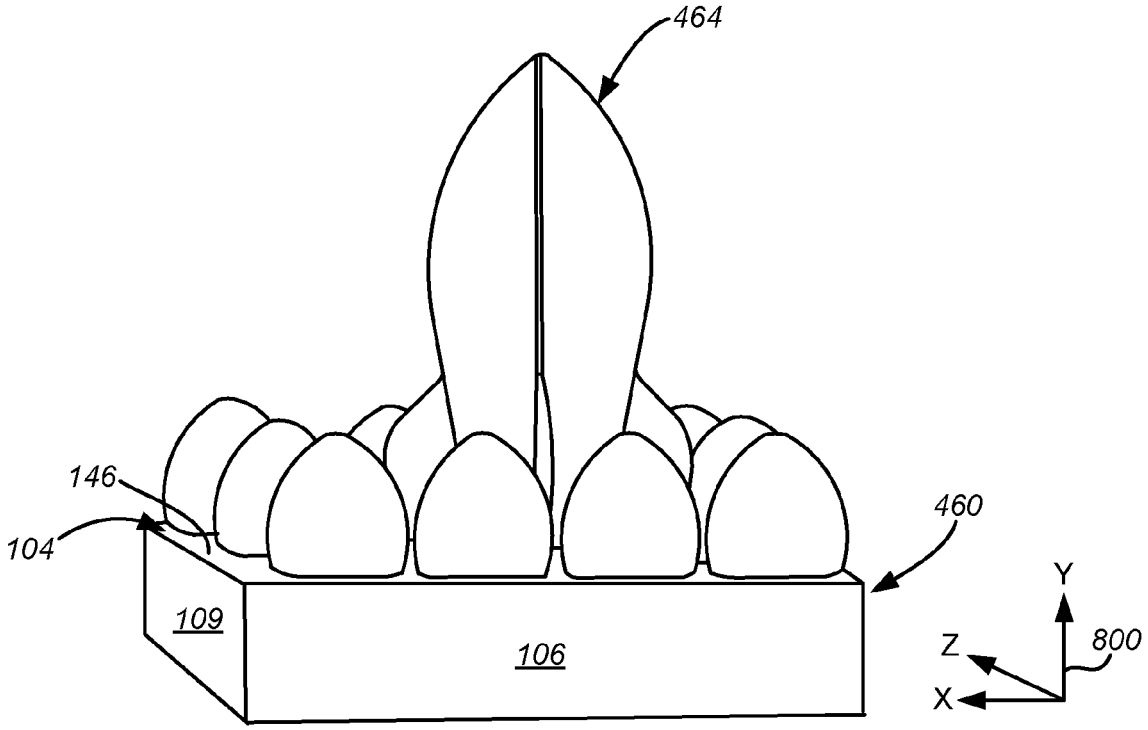
FIG. 12 illustrates a top perspective view of the carton illustrated in FIG. 6 including the attachment illustrated in FIGS. 10-12.

FIG. 10 illustrates a perspective view of attachment 464 attached to carton 460 and FIG. 11 illustrates a top view of attachment 464 attached to carton 460. As illustrated, first and second pieces 465 and 466 are coupled together such that first slot 474 of first piece 465 mates with second slot 476 of second piece 466 such that first piece 465 is oriented substantially normal to second piece 466 and thereby forms a three dimensional attachment 464. Each of tabs 480 (not illustrated in FIGS. 7 and 8) are inserted into through cuts 152, 154, 156, and 158 of top panel 104. In particular, first tab 480-1 is inserted into through cut 152, second tab 480-2 is inserted into through cut 154, third tab 480-3 is inserted into through cut 156 and fourth tab 480-4 is inserted into through cut 158. As illustrated in the front perspective view of carton 360 of FIG. 12, attachment 464 attaches to top panel 104 and protrudes or projects upwardly or along a Y axis from exterior surface 146 of top panel 104 adjacent the decorated eggs. In particular, a top of attachment 464 extends above the decorated eggs.

Figure 13:
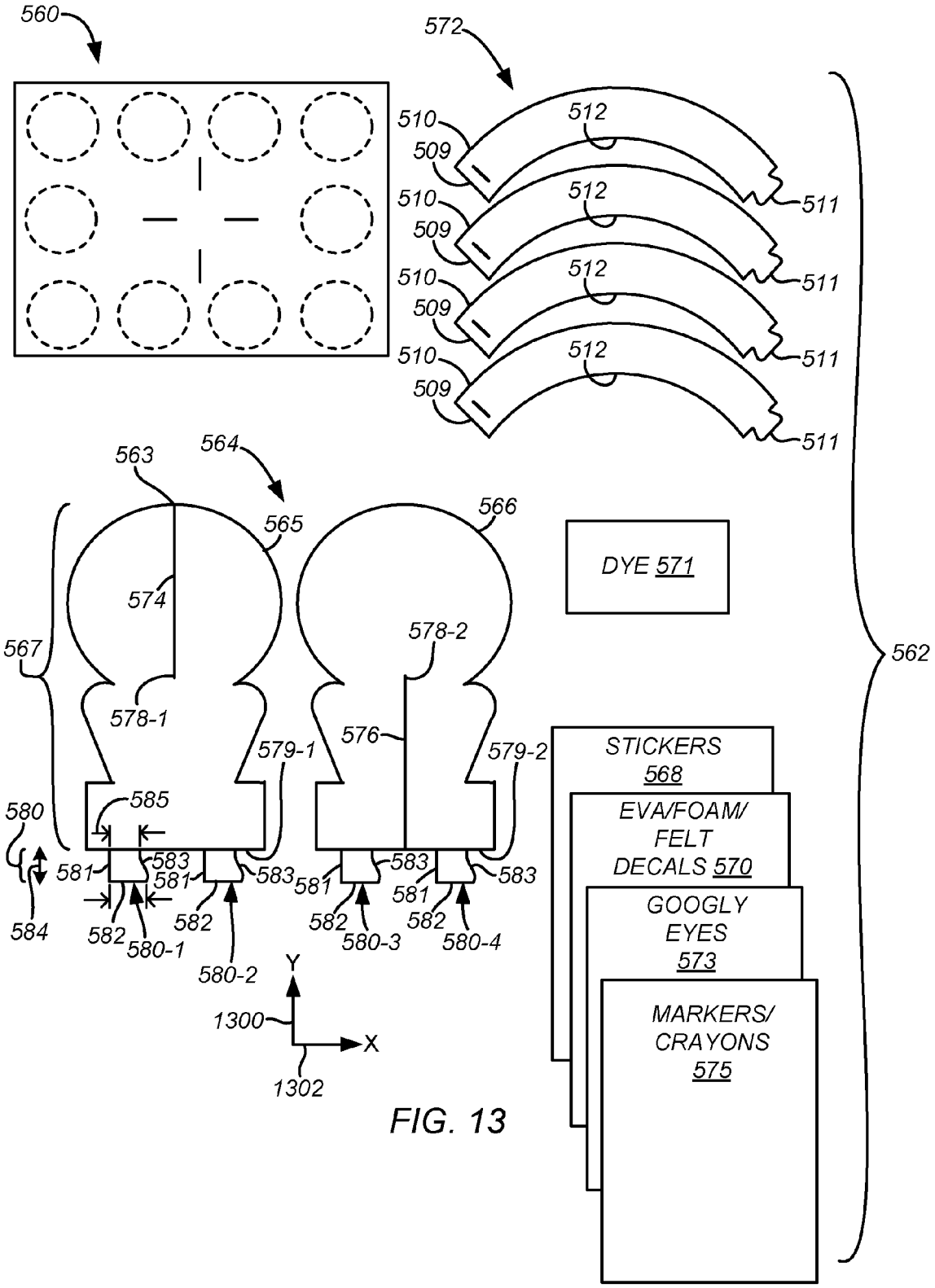
FIG. 13 illustrates an egg decorating kit according to another embodiment.

FIG. 13 illustrates a plurality of items or supplies 562 included in an egg decorating kit according to another embodiment. Items 562 include a carton or box 560, such as the carton or box 360 illustrated in FIGS. 4-8 and formable from sheet material 100 of FIG. 1; an attachment 564 made of sheet material; a plurality of egg stands 572 made of sheet material; and a plurality of egg decorating accessories for decorating eggs.

The attachment 564 is for attaching to carton 560. The egg stands include top arc edges 510 that have lengths that are substantially the same as the length of their bottom arc edges 512. The two side edges 509 and 511 of each egg stand 572 attach together to form a circular support for supporting an egg. For example, the side edges 509 and 511 can include a tab and slot as illustrated in FIG. 13 for connecting together or adhesive. The plurality of decorating accessories include decals, such as a plurality of stickers 568 mounted to a liner sheet, a plurality of EVA, felt or foam pieces 570, a plurality of googly eyes 573, at least one marker and/or crayon 575 and dye 571.

Attachment 564 includes at least a first piece or first attachment 565 and a second piece or second attachment 566. Both first piece 565 and second piece 566 have main body portions 567 that represent a popular shape and include indicia related to the shape, which is printed on both a front side of main body portion 567 and on the back side of main body portion 567. As illustrated in FIG. 13, main body portions 567 represent flowers. However, other shapes and printed indicia can be used.

The main body portion 567 of first piece 565 includes a first slot 574 and main body portion 567 of second piece 566 includes a second slot 576. First slot 574 of first piece 565 extends from a top end 563 of first piece 565 or, in other words, from an edge of the top of the flower and terminates at a terminating point 578-1. Second slot 576 of second piece 566 extends from a bottom edge 579-2 of the main body portion 567 or, in other words, from a base of the flower and terminates at a terminating point 578-2 of the second piece 566.

Figure 14:
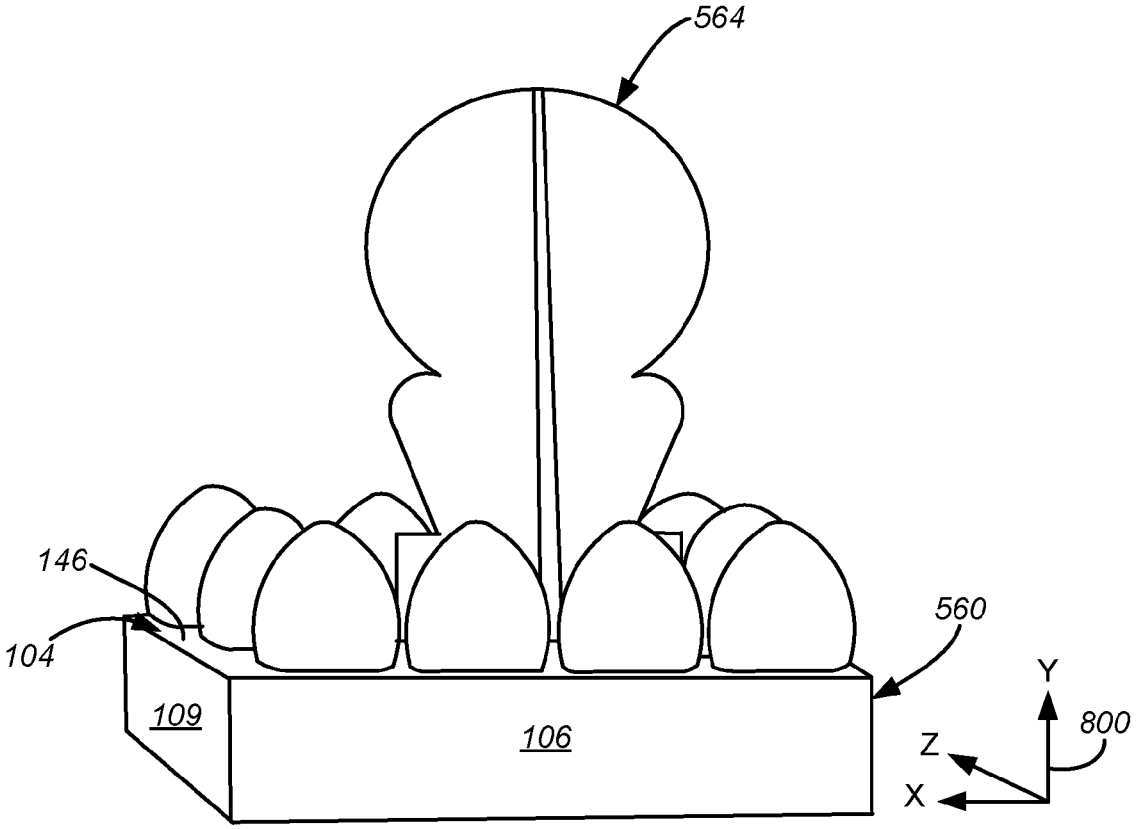
FIG. 14 illustrates a top perspective view of the carton illustrated in FIG. 6 including the attachment illustrated in FIG. 13.

First and second pieces 565 and 566 of attachment 564 also include tab portions 580 having downwardly depending tabs. As illustrated, the tab portions of first piece 565 include a first tab 580-1 and a second tab 580-2 coupled to or depending downwardly from a bottom edge 579-1 of main body portion 567 and terminating at free edges. The tab portions of second piece 566 includes a third tab 580-3 and a fourth tab 580-4 coupled to or depending downwardly from a bottom edge 579-2 of main body portion 567 and terminating at free edges. Tabs 580-1, 580-2, 580-3 and 580-4 include three free edges. A first free edge 581 is a vertical straight edge oriented along a Y axis 1300, second free edge 582 is a horizontal edge oriented along an X axis 1302 and third free edge 583 is a curved edge, which opposes vertical edge 581. While each tab 580-1, 580-2, 580-3 and 580-4 includes a single length 584, each tab 580-1, 580-2, 580-3 and 580-4 includes two widths. A first width 585 extends along the bottom edges 579-1 and 579-2 or base of the flowers and is less than a second width 586 that extends along second free or horizontal edge 582. First width 585 substantially corresponds with the length of each of the through cuts in the top panel of carton 560. Therefore, As illustrated in the front perspective view of carton 560 of FIG. 14, tab portions of first piece 565 and tab portion of second pieces 566 are inserted into through cuts 152, 154, 156 and 158 so that attachment 564 attaches to top panel 104 and protrudes or projects upwardly or along a Y axis 800 from exterior surface 146 of top panel 104 adjacent the decorated eggs. In particular, a top of attachment 564 extends above the decorated eggs.

An egg display can be assembled together using the described egg decorating kit. Sheet material is obtained to form a carton. With reference back to FIGS. 1-8, the carton includes a top panel 104 having a plurality of perforated sections 160-169 and at least one slit spaced apart from the plurality of perforated sections. At least one of the plurality of perforated sections 160-169 is removed from the top panel to form at least one opening. At least one egg is placed in the at least one opening. A tab of the attachment 464 or 564 included in egg decorating kit 462 or 562 is inserted through the at least one slit in the top panel 104 such that at least a portion of the attachment extends above the at least one decorated egg.

In accordance with one embodiment, before placing the decorated egg in the at least one opening, the at least one egg is decorated using egg decorating accessories included in egg decorating kit 462 or 562, such as dying the egg and adhering stickers to the egg. Before inserting the tab of the attachment through the at least one slit or through cut in the top panel, the attachment is assembled by mating a first piece of the attachment with a second piece of the attachment. To mate the first piece with the second piece, a first slot that extends from a top of the first piece to a terminating point in the first piece is inserted into a second slot that extends from a bottom of the second piece to a terminating point in the second piece so that the first piece is located substantially normal to the second piece. After the attachment is assembled, the tabs of the attachment can be inserted through the through cuts located in the top panel of the carton. Rather than carton acting as a place to hold eggs for display, the combination of the attachment and the carton provide an environment for the eggs to be displayed.

The various described egg decorating kits can also be constructed. In particular, sheet material 100 can be formed into a carton having a top panel 104. Top panel 104 is pierced including making a plurality of perforated sections and at least one slit or through cut spaced apart from the plurality of perforated sections 16-169. The plurality of decorating accessories are inserted into the carton including accessories for decorating eggs and at least one attachment for attaching to the carton through the at least one slit in the top panel.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An egg decorating kit, comprising:

a sheet of material formed into a carton, said carton containing a plurality of egg decorating accessories, egg stands and a decorative attachment;

said sheet of material having a rectangular top panel defined by a first score line, a second score line, a third score line and a fourth score line, said first and second score lines being substantially perpendicular to said third and fourth score lines;

said sheet of material having a bottom panel defined by a first edge and a second edge and a fifth score line and a sixth score line, said fifth and sixth score lines extending substantially perpendicular to said first edge and said second edge;

said sheet of material further including a front panel positioned between said top panel and said bottom panel and defined by said second score line and said fifth score line and a seventh score line and an eighth score line;

said sheet of material further including a back panel adjacent said top panel and defined by said first score line and a ninth score line and a tenth score line and a free edge wherein said ninth and tenth score lines are substantially perpendicular to said first score line and said free edge;

said top panel further including a plurality of removable perforated sections wherein the perforated sections define geometric shapes so that upon removal of at least one of the plurality of perforated sections an egg-sized opening is created;

said top panel includes four slits located equidistantly about a central point;

said decorative attachment formed of a first section of flat material and a second section of flat material;

each of said first and second sections of flat material having a pair of tabs sized to extend through two of said four slits in said top panel;

said first section of flat material includes a first section top portion and a first section bottom portion wherein the first section bottom portion rests on said top panel when said sheet of material is folded to form a carton and includes said pair of tabs extending through a pair of said slits in said top panel;

said first section of flat material further includes a first slit in said first section bottom portion that extends toward the first section top portion;

said second section of flat material includes a second section top portion and a second section bottom portion wherein the second section bottom portion rests on the top panel when said sheet of material is folded to form a carton and includes a pair of tabs extending through two of said slits in said top panel;

said second section of flat material includes a second slit that extends in said second section top portion;

said first section of flat material and said second section of flat material can be coupled together by placing said first section of flat material onto said second section of flat material so that the second section bottom portion extends into said first slit and the first section top portion extends into said second slit;

and, said egg stands made of arcuate sheet material having opposite side edges that connect together to form a circular support.

2. The egg decorating kit, as set forth in claim 1, wherein:

said sheet of material being foldable along said first, second, and fifth score lines to form a carton wherein the top panel is located above said bottom panel and spaced therefrom.

3. The egg decorating kit, as set forth in claim 1, wherein:

said top panel and said bottom panel are of equal dimensions.

4. The egg decorating kit, as set forth in claim 3, wherein:

said front panel and said back panel are of equal dimensions.

5. An egg decorating kit comprising:

a carton containing a plurality of egg decorating accessories and a decorative attachment, said carton being formed of a sheet of material;

said sheet of material having a rectangular top panel defined by a first score line, a second score line, a third score line and a fourth score line, said first and second score lines being substantially perpendicular to said third and fourth score lines;

said sheet having a bottom panel defined by a first edge and a second edge and a fifth score line and a sixth score line, said fifth and sixth score lines extending substantially perpendicular to said first edge and said second edge;

said sheet further including a front panel vertically positioned between said top panel and said bottom panel and defined by said second score line and said fifth score line and seventh score line and an eighth score line;

said sheet further including a back panel vertically positioned adjacent said top panel and defined by said first score line and a ninth score line and a tenth score line and a free edge wherein said ninth and tenth score lines are substantially perpendicular to said first score line and said free edge;

said top panel further including a plurality of removable perforated sections wherein the perforated sections define geometric shapes so that upon removal of at least one of the plurality of perforated sections an opening is created;

said geometric shapes are configured to retain an egg in an upright position when the perforated sections are removed;

said top panel includes four slits located equidistantly about a central point;

said decorative attachment, for connection to said top panel, is formed of a first section of flat material and a second section of flat material;

each of said first and second sections of flat material having a pair of tabs sized to extend through two of said four slits in said top panel for connecting the decorative panel to the top panel; and, said plurality of egg decorating accessories including dye, decals and a marker; and, further comprising a plurality of egg stands made of arcuate sheet material having opposite side edges that connect together to form a circular support.

6. The egg decorating kit, as set forth in claim 5, wherein:

said first section of flat material includes a top portion and a bottom portion wherein the bottom portion rests on said top panel when said sheet of material is folded to form a carton and includes said pair of tabs extending through a pair of said slits in said top panel;

said first section of flat material further includes a first slit in said bottom portion that extends toward the top portion;

said second section of flat material includes a top portion and a bottom portion wherein the bottom portion rests on the top panel when said sheet of material is folded to form a carton and includes a pair of tabs extending through two of said slits in said top panel;

said second section of flat material includes a second slit that extends in said top portion; and, said first section of flat material and said second section of flat material can be coupled together by placing said first section of flat material onto said second section of flat material so that the second section bottom portion extends into said first slit and said first section top portion extends into said second slit.

7. The egg decorating kit, as set forth in claim 5, wherein:

said top panel and said bottom panel are of equal dimensions.

8. The egg decorating kit, as set forth in claim 5, wherein:

said front panel and said back panel are of equal dimensions.

9. The egg decorating kit, as set forth in claim 5, wherein:

a tuck flap is located adjacent said bottom panel so that when the sheet of material is folded to form a carton, said tuck flap can be adhered to said back panel.

* * * * *